US007244201B2

(12) United States Patent
Hale

(10) Patent No.: US 7,244,201 B2
(45) **Date of Patent: *Jul. 17, 2007**

(54) GAME STICK AND BALL

(75) Inventor: Marvin J. Hale, Ray Township, MI (US)

(73) Assignee: Hale-O-Hockey L.L.C., Ray Township, MI (US)

( * ) Notice: Subject to any disclaimer, the term of this patent is extended or adjusted under 35 U.S.C. 154(b) by 163 days.

This patent is subject to a terminal disclaimer.

(21) Appl. No.: 10/794,821

(22) Filed: Mar. 8, 2004

(65) Prior Publication Data

US 2005/0197205 A1 Sep. 8, 2005

(51) Int. Cl.
*A63B 59/12* (2006.01)
*A63B 67/14* (2006.01)

(52) U.S. Cl. ..... 473/560; 273/129 R

(58) Field of Classification Search ..... 473/505, 473/559–563, 510–515, 457; D21/722; 273/129 R, 273/129 K, 129 L, 129 M
See application file for complete search history.

(56) References Cited

U.S. PATENT DOCUMENTS 1,530,573 A * 3/1925 Olcott ..... 473/513
2,935,323 A * 5/1960 Cummings ..... 273/129 R
3,052,226 A * 9/1962 Woll ..... 473/471
3,169,019 A * 2/1965 Genjack ..... 473/457
3,228,693 A 1/1966 Ingebo
3,844,555 A * 10/1974 Tremblay ..... 473/563
D246,006 S 10/1977 Burr et al.
4,930,772 A * 6/1990 Maloney et al. ..... 473/457
D325,612 S * 4/1992 Longo ..... D21/725
D340,752 S 10/1993 Flynn et al.
D347,456 S * 5/1994 Wire ..... D21/785
5,333,867 A 8/1994 DiVito
5,368,306 A * 11/1994 Madsen ..... 473/510
5,478,283 A 12/1995 Ingebo
5,674,141 A * 10/1997 Laforest ..... 473/559
6,290,619 B1 9/2001 Mayer, II
6,547,683 B1 4/2003 Howgate
6,645,098 B1 11/2003 Quinn
D507,027 S * 7/2005 Hale, Jr. ..... D21/722
2002/0072436 A1 * 6/2002 Liu ..... 473/457

* cited by examiner

*Primary Examiner*—Mark S Graham

(57) ABSTRACT

A game stick for playing a game with a spherical ball is disclosed. The game stick is used for propelling and controlling the ball over a flat playing surface. The stick includes a toroidal body having a downwardly facing cup-shaped frusto-spherical depression and a shaft allowing a running or skating player to propel and control the ball.

13 Claims, 5 Drawing Sheets

GAME STICK AND BALL

BACKGROUND OF THE INVENTION

This invention relates to a game stick that used for playing a game similar to ice hockey. More specifically, it relates to a ball-handling device for rolling and passing (throwing) a spherical ball and a ball to be used therewith.

The game of hockey is a well known team sport that is played around the world with a hockey stick and a hard rubber cylindrical puck.

A hockey stick can be made of wood, fiber glass, polymer or other materials and includes a generally flat, perhaps slightly curved, blade on the end of an elongate shaft that extends from the blade at an angle of between about 40 and 60 degrees.

The length of the shaft may be prescribed by the rules of the game, as is the case in hockey, but is largely a matter of preference of the player. In hockey, the rules limit the overall length of a hockey stick to 60 inches or less, and that rule can be applied to the game stick of the present invention if desired.

In ice hockey, the blade is used for handling, i.e., controlling the movement of, a puck as a player skates on the ice. More specifically, the hockey stick is used to move and maneuver the puck along the ice, pass the puck to teammates, stop and control the puck when passed by another player, take possession of the puck away from a player on the opposing team, intercept the puck when a pass is attempted between players, and throw or hit the puck toward a team mate or the net to score a goal.

Variations on the game of ice hockey have evolved. One variation of ice hockey replaces the puck with a spherical ball and the game is played on a rink defined by a flat surface with the players using skates. Also, the game can also be played on a dry surface where the players can either use roller-type skates or run. The game of hockey played on a dry surface rink is sometimes referred to as street hockey. The present invention relates to a game stick and ball that can be used in a dry surface rink variation of hockey.

As used throughout this application, the word equator means "a circle dividing the surface of a spherical body into two usually equal and symmetrical parts and does not imply or require any specific orientation of such circle with respect to any external reference point." However, the term "upper hemisphere" means "the hemisphere of a spherical body that is a generally Northerly extending hemisphere."

U.S. Design Pat. No. 246,006, issued Oct. 4, 1977 to Burr, et al. entitled Ball Rolling Game Stick includes an ornamental design for ball rolling device that comprises a circular toroidal ring mounted at angle on a stick or shaft. The shaft allows the player to assume a comfortable attitude while using the game stick and rolling the ball. The inner surface of the toroidal ring is circular. Although not described in the design patent, the apparent purpose of the ring is to provide control over the movement of a rolling ball that is being propelled by movement of the ring.

Nothing is shown in the Burr design patent regarding the diameter of either the toroidal ring or the ball that is used with the device. However, it appears that the ball could be of any diameter less than the diameter of the opening defined by the circular torus. Also, apparently the ball would be rolled by holding the axis of the circular opening generally perpendicular to the playing surface or the earth and applying a lateral force at the point of contact between the toroidal ring and the ball.

Free rolling of the ball would probably be best accomplished if the contact between the ring and the ball were at or very near the equator of the ball.

Hence, in the Burr patent, the toroidal ring should contact the ball at or near the equator of the ball to keep the ball rolling freely on the game surface. This would require that the device be held at a substantially constant altitude above the playing surface.

It would require substantial skill to control the altitude of the ring within such a narrow range especially while a player is skating or running. Also, the need to keep the ring above the playing surface would deprive the player of the ability to use the device for additional stability during skating, turning and stopping while maintaining control over the movement of the ball.

U.S. Design Pat. No. 340,752 issued Oct. 26, 1993 to Flynn, et al. entitled Stick For Throwing a Ball is an ornamental design for an annular ring that is flattened on the bottom and mounted at an angle on a shaft. As with U.S. Design Pat. No. 246,006, there is no description in Flynn et al. of the intended use or function of the stick. From the title, it is apparently intended for use with a ball having a diameter larger than the diameter of the annular ring. It appears that the stick is used to gain leverage in throwing a ball placed on the annular ring.

U.S. Pat. No. 3,228,693 issued Jan. 11, 1966 to Ingebo entitled Ball Handling Implement discloses a pusher device for rolling a bowling ball. The device is attached to a handle or stick and has a pair of low friction rollers located on the lateral sides of the device at or near the equator of the bowling ball. These rollers facilitate rolling of the ball about a horizontal axis that is perpendicular to the direction of motion of the shaft. A ring member is provided to enclose the ball and prevent it from leaving the pusher device unless released by the pusher. The ring can be lifted to release the ball to allow the bowl to roll free of control of the pusher device.

U.S. Pat. No. 5,478,283 issued Dec. 26, 1995 to Hoblit entitled Bowling ball propulsion devices shows a pushing device for a bowling ball. The pushing device has a shaft attached to a floor engaging U-shaped frame. The frame has low friction pads located to engage the bowling ball on the equator at a rearmost location and two lateral side locations. The low friction contact points with the bowling ball allow the ball to rotate freely relative to the pushing device. The low friction contact points also allow correction of lateral deviation of the bowling ball. The speed of the ball is determined by the speed at which the ball is being pushed. The Hoblit device has no mechanism for restraining or controlling the forward progress of the ball.

U.S. Pat. No. 6,547,683 B1 to Howgate issued Apr. 15, 2003 for a Hockey Stick discloses a hockey stick having, in some embodiments, a C-shaped ball-handling member.

U.S. Pat. No. 6,645,098 issued Nov. 11, 2003 to Quinn discloses a street hockey ball that comprises a smooth spherical shell with a hollow interior cavity that is partially filled with a liquid and prills (floating solids) to improve the stability of movement of the ball.

U.S. Pat. No. 6,290,619 issued Sep. 18, 2001 to Mayer, II discloses a spherical ball for use in playing hockey. The ball is sized to contact the hockey stick at the same height as a cylindrical hockey puck thereby giving a "feel" that is similar to hitting a puck.

BRIEF SUMMARY OF THE INVENTION

This invention relates to a game stick for rolling, passing and throwing a spherical ball in playing a game like hockey on a dry level surface.

A primary object of the invention is a game stick that provides a running or skating player with control over a rolling ball and the ability to pass or shoot the ball to another player or towards a goal.

The game stick of this invention is used to move and maneuver a spherical ball along the surface of a dry rink, pass the ball to teammates, stop and control the ball when passed by another player, take possession of the ball away from a player on an opposing team, capture and intercept the ball when a pass is attempted between team members, and throw or hit the ball toward a team mate or the net to score a goal.

The invention can be used to play different games involving either individuals or teams, but is primarily intended for use in a dynamic, team game similar to ice hockey. The game stick and ball are intended for, but not strictly limited to, use in a game played on a flat level surface having higher coefficient of friction than ice.

The game stick comprises an elongate handle or stick connected to a toroidal ball control device that includes an inverted cup-shaped member having a frusto-spherical surface therein. The cup-shaped member is open at the bottom and is preferably also be open at the top.

A spherical radius defines the inverted cup-shaped surface in the toroidal device. The inner surface of the cup-shaped member provides a spherical surface that is slightly larger, e.g., 0.025 to 0.50 inches larger in radius, but generally matches and mates with the spherical outer surface of a game ball that is used in a game played with the use of the game stick. The frusto-spherical cup-shaped surface covers the game ball to an extent that is preferably between about 20 and 60 degrees measured from the equator of the ball defined by such surface toward the north.

As stated above, in the preferred embodiment, the radius of the spherical inner surface is only slightly greater than the radius of the spherical game ball. However, it is also possible to use a game ball that has a significantly smaller radius than the spherical radius of the cup-shaped surface.

At the larger open lower end, the cup-shaped member of the game stick has a circular opening that slightly exceeds the diameter of the game ball. In the preferred embodiment, it is intended that the cup-shaped frusto-spherical surface will cover the ball to the level of the equator of the ball. Hence, the cup-shaped frusto-spherical surface can be brought over and into contact with about the upper hemisphere of the ball.

The presence and size of the upper opening in the toroidal member of the game stick is discretionary and depends upon the thickness selected for the ball-handling member but is not critical to proper functioning of the game stick. An upper opening permits a player to observe the rolling ball. The motion of the rolling ball provides information that can be useful the player in determining if an adjustment is needed in terms of the force applied to the ball to change the frictional force between the ball and the game stick to achieve and maintain optimum control over movement of the ball.

Hockey involves hitting the puck or ball using a swinging, slapping or swiping motion of the hockey stick to propel the puck to another player or toward the goal. The stick can be raised off the ice, taken backwardly by the player's arms to a position giving the player large leverage over the stick and swung forwardly and downwardly with significant speed and force to impact the ball.

This swinging technique and resulting slap shots are possible with the present invention for players of having sufficient skill. However, an important objective of the invention is to foster playing skills in ball handling and control through capture and control over the rolling ball rather than develop skill in driving the ball towards a goal through impact.

To achieve accuracy over the path of a passed or thrown ball using toroidal device having a generally circular outer periphery requires a player to use a "side arm" throwing or sweeping motion to accelerate the ball-handling member and ball while maintaining the ball between the playing surface and the cup-shaped depression in the ball-handling member.

The angular extent of the inner spherically radiused surface area of the ball control device can be changed thus giving a different frictional resistance to the rolling motion of the ball and changing the ball handling and control characteristics of the device when the ball is carried, passed or thrown to another player or towards a goal.

The game stick can have different or variable lengths to accommodate differences in the sizes or preferences of players. Normally, providing the stick with an angle of about 40 to about 60 degrees with respect to the annular ring and a length reaching to near the waist of the player is appropriate for most players. The stick is given a length that is appropriate to allow a person to comfortably run or skate and use the stick to provide the player with additional stability during running or skating and maneuvering the ball and to control, pass or throw the ball.

The stick portion may be made integral with, or removably attached to, the cup-shaped member and is used to propel, direct and control the speed and direction of the ball.

Also, as stated above, the preferred game ball used with this invention preferably has a radius that is slightly less than the radius of the spherical surface of the cup-shaped member. It is intended that the cup-shaped member will, as far as possible, provide an area of contact between the ball. The area of contact will extend from near the equator of the ball upwardly. The contact between the ball control device and the ball will provide good retention and control over the ball and the direction of movement thereof during ball handling, passing or shooting.

The frusto-spherical inner surface of the cup-shaped member and the ball should have low coefficients of friction, and low frictional forces therebetween, allowing the ball to roll on the game surface and slide with respect to the cup-shaped device.

The Flynn et al. device has an annular ring and is used to provide a person with a greater leverage in throwing a ball by extending the effective length of the thrower's arm and thereby increase the launch speed of a thrown ball, but does not appear to be otherwise relevant to the present invention.

The prior art Ingebo patent discloses a device that provides limited control over a ball that is being pushed, essentially in a straight line by providing an encircling ring for stopping the ball if it becomes apparent to the person pushing the ball that the direction of roll is undesirable.

The Ingebo patent doesn't specify the diameter of a ball that can be used with the Ingebo device. Presumably, the ball would have a diameter that is slightly less than the inner diameter of the toroidal ring such that the ball is contacted essentially at a single point on the surface of the toroid. The circular shape of the opening in the Ingebo toroidal ring presents only point contact to a smaller diameter ball. This would provide the player with difficulty in using the ball for additional stability and support and in maintaining smooth rolling of the ball which is one objective of the present invention. Also, good control during rapid changes in speed or direction, passing or throwing of the ball using the toroidal ring of the Ingebo patent as are intended by the present invention do not appear practical.

Hence it is an object of the present invention to provide a game stick that includes a ball controlling device that permits a participant in a game of hockey, or other game, effective control over the speed and direction of a rolling ball and the ability to hit, pass or throw the ball to a team member or towards a goal.

DETAILED DESCRIPTION OF THE INVENTION

Figure 1:
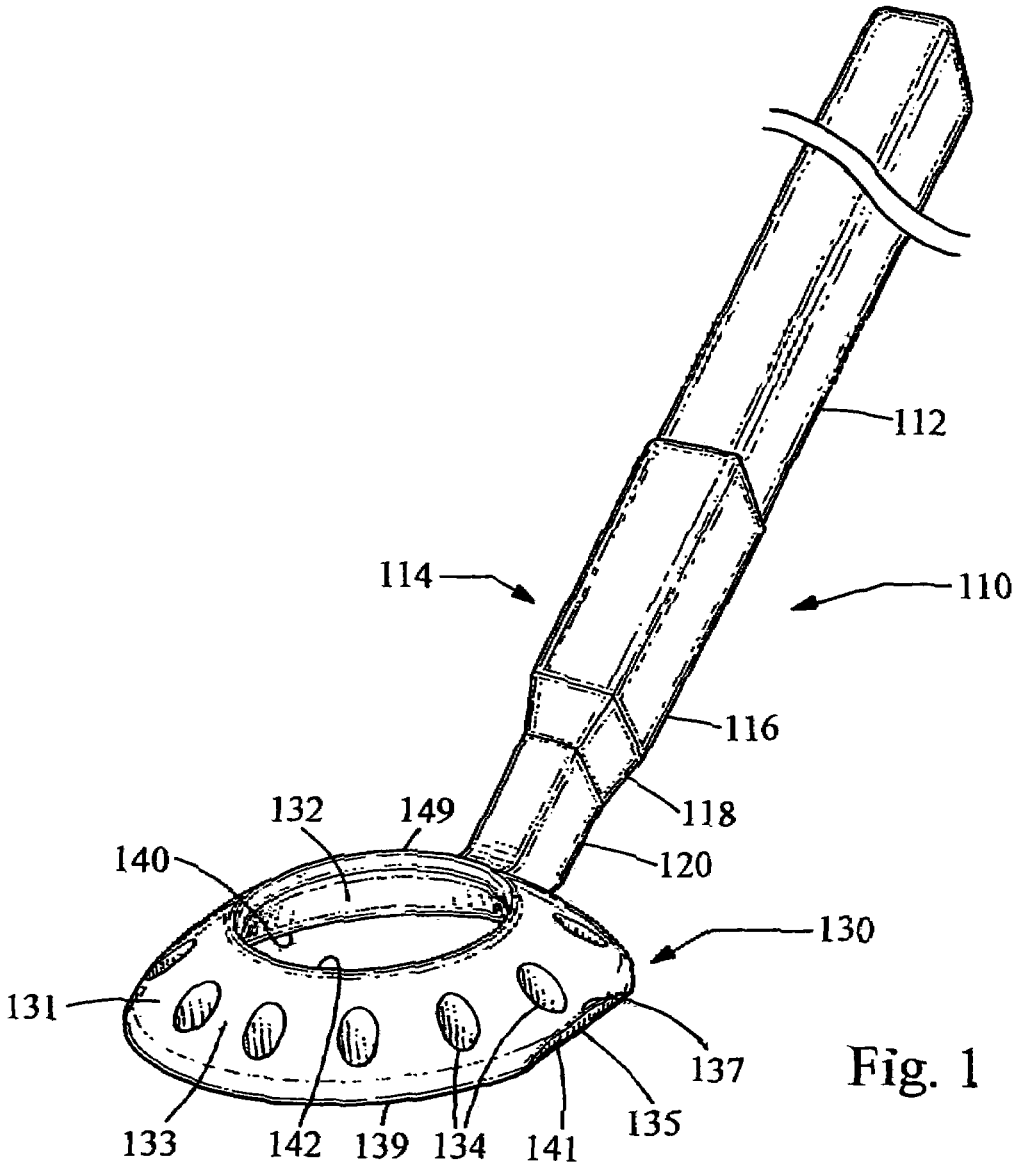
FIG. 1 is a perspective view of one embodiment of a game stick of the present invention.

As shown in FIG. 1, this invention relates to a game stick 110 and a spherical game ball 150.

The game stick 110 comprises a shaft 112, a shaft connecting section 114 including a shaft connection portion 122, a transition portion 121 and a stem portion 120, and a ball-handling member 130.

The shaft 112 is elongate and shown as being hollow and rectangular in cross-section defining a female surface 113. However, the shaft 112 could also be solid. The shaft 112 can be made of any suitable material such as wood, polymer, fiber-reinforced glass, fiber-reinforced polymer, fiber-reinforced carbon or other materials having high strength to weight properties but is preferably fiber-reinforced polymer. Also, the shaft 112 can be manufactured either separately to allow easy replacement thereof, or as an integral part of the shaft connecting section 114 so that the game stick 110 is a unitary structure.

Figure 3:
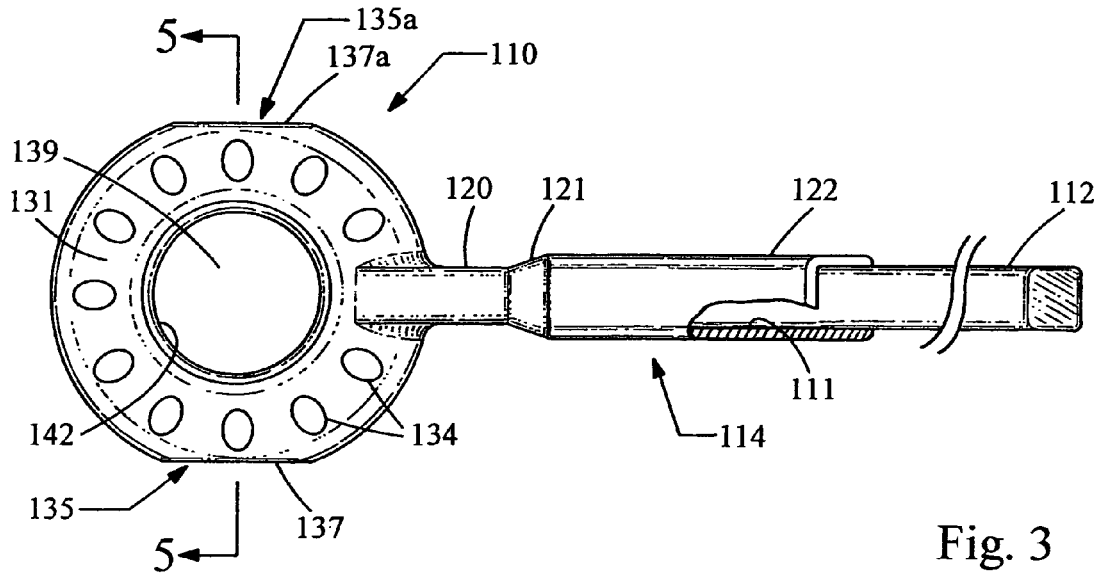
FIG. 3 is a top plan view of the game stick of FIG. 1.
Figure 7:
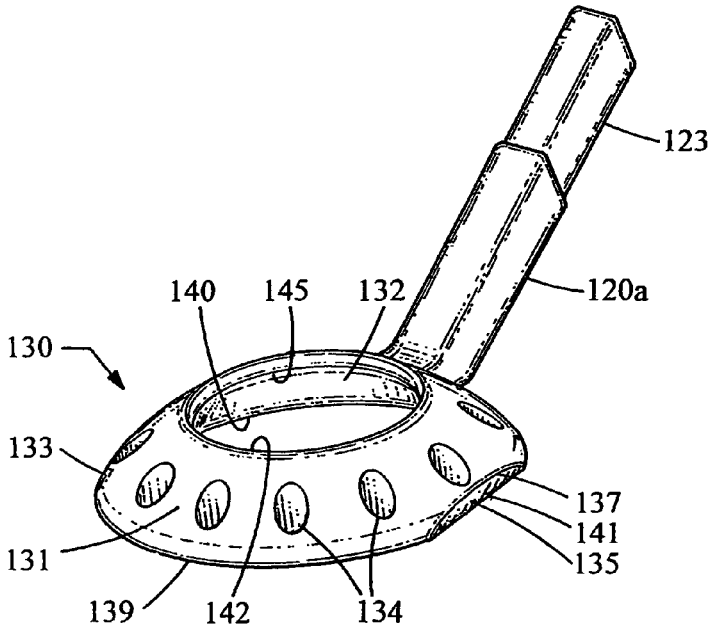
FIG. 7 is a perspective view of the ball-handling member of the game stick of the present invention illustrating an alternative connection of the shaft to the ball handling device.
Figure 7A:
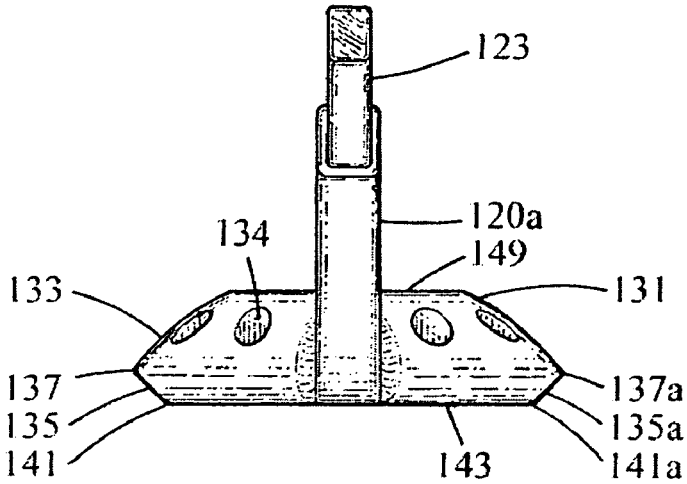
FIG. 7*a* is a rear plan view of the ball-handling member of the present invention further illustrating the alternative connection to the shaft shown in FIG. 7.
Figure 7B:
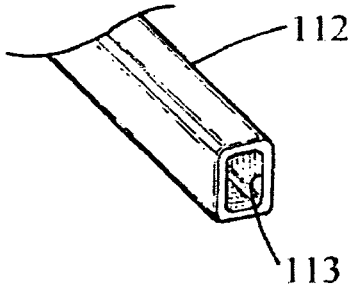
FIG. 7*b* is a partial perspective view of the shaft used with the alternative connection shown in FIG. 7 and 7*a*.

As is shown in FIG. 3, the shaft 112 can be made with a generally rectangular tubular cross-section and can be inserted into a female portion 111 of a shaft connection portion 122. Alternatively, as shown in FIGS. 7, 7*a*, and 7*b*, the stem portion 120*a* can have a male projection 123 which can be inserted into a female opening defined by inner surface 113 of tubular shaft 112. The shaft 112 may be held in place on the shaft connection portions 122 or 123 by any suitable fastening means such as by friction using an interference fit, welding, adhesive, or threaded fasteners or made as an integral part of the shaft connecting portion 114.

Preferably, the stem portion 120, transition portion 121 and shaft connection portion 122 may be manufactured integral with the ball-handling member 130 such as by injection molding or other casting technique. Alternatively, but less desirably, the shaft connecting portion 114 can be made separate from the ball-handling member 130 and attached thereto by suitable fastening means such as adhesive or welding.

As shown in FIG. 1 the ball-handling member 130 comprises a generally circular toroidal body 131. The toroidal body 131 may be provided with a plurality of through holes or openings 134. The openings 134 are optional and can be used to control the mass of the toroidal body 131.

Figure 2:
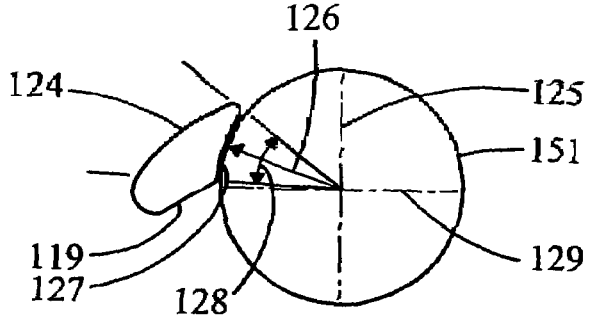
FIG. 2 is an example of a closed curve that can be used to generate a toroidal shape for the ball-handling member of the game stick of the present invention.

FIG. 2 shows a closed curve 124 that can be used to generate the form of toroidal body 131. Rotating the closed curve 124 about a vertical axis 125 at a radius 126 forms the toroidal member 131. The closed curve 124 includes an arcuate portion 127 also defined by the radius 126 and an included arc defined by an angle 128. When rotated through 360 degrees about the vertical axis 125, the curve generates the toroidal body 131 of ball handling member 130, the arcuate portion 127 defines a downwardly facing open cup-shaped frusto-spherical internal surface 132 and a downwardly facing open frustoconical surface 147.

The angle 128 can have any value from a 5 degrees up to 90 degrees, but the angle is preferably greater than about 20 degrees and less than about 60 degrees. The radius 126 is shown with reference to circle 151 having a diameter that is slightly larger, by 0.050 to 0.100 inch, than game ball 150.

The frustoconical surface 147 can have any desired angle with respect to the frusto-spherical surface so long as the smallest diameter thereof is larger than the diameter of the ball 150, which is necessary to allow the toroidal body 131 to fit over the diameter of the ball 150.

Shown in perspective in FIG. 1, and in more detail in the sectional views of FIGS. 5, 5*a*, 5*b*, 5*c*, and 5*d*, the toroidal body 131 of the ball-handling member 130 comprises a larger generally circular periphery 139 defining a lower generally circular radiused edge 143, flat champhered surfaces 135 and 135*a*, a generally circular upper edge 149, and an arcuate outer surface 133 extending from the circular lower edge 143 to the upper edge 149.

The champhered surfaces 135 and 135*a* (defined by edges 137, 137*a* and 141, 141*a*) are located on each side of the toroidal body 131 and are generally parallel to the longitudinal axis of the shaft 112.

The toroidal body 131 also includes a downwardly facing, frusto-spherical surface 132 and a frustoconical surface 147 extending from a lower edge 144 of the spherical surface 132 downwardly and radially outwardly to the circular lower edge 143. The arcuate outer surface 133 and frustoconical surface 147 meet and are joined at the circular periphery 139 by a radius at the lower edge 143 of the toroidal body 131.

In FIG. 1, the shaft 112 is attached to the toroidal body 131 at an angle of between about 40 degrees and 60 degrees when the body 131 is sitting flat on a horizontal surface.

As shown in FIG. 3, the shaft 112 is connected to the shaft connection portion 122. The shaft 112 may have various lengths depending upon the size of the player or the rules of the game.

The shaft 112 should be long enough to permit the player to run or skate in a forward leaning, generally upright position and have the toroidal body 131 of the ball handling and control member 130 at location providing the player with comfortable control over the ball 150. Also, the shaft 112 should be long enough to provide the player with sufficient leverage to accelerate and propel the ball 150 to another player or to the goal.

In most cases, an appropriate length would be for the shaft to extend from the ball-handling member 130 to about the player's waist when the ball-handling member 130 is sitting flat on the playing surface 155. As shown in the perspective view of FIG. 2 and FIG. 4, the toroidal body 131 includes the downwardly opening frusto-spherical surface 132 and the further radially outwardly and downwardly extending frustoconical surface 147.

Figure 8:
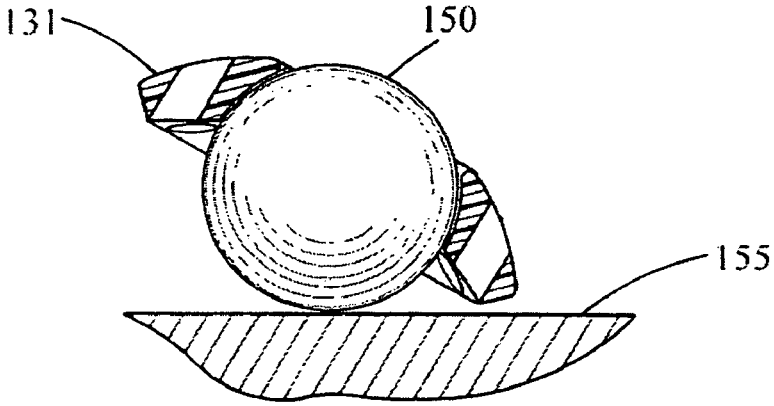
FIG. 8 is a partial sectional view of the ball-handling member taken along the section line 5-5 in FIG. 3 illustrating another operative position of the ball-handling member.

The flat surfaces 135 and 135*a* are defined by a champher taken at about 45 degrees on each side of the toroidal body 131 in a direction parallel to the shaft 112. The resulting surfaces 135 and 135*a* are generally D-shaped defined by arcuate upper edges 137 and 137*a* and straight lower edges 141 and 141*a*. The purpose of the champhered surfaces 135 and 135*a* is to allow the toroidal body 131 to be tilted to a position as shown in FIG. 8 for reasons that will be described in detail in the discussion of FIG. 8.

The inner frusto-spherical surface 132 of ball-handling member 130 extends from the equator 129, or slightly above, of the ball 150 upwardly to an angle 128 of less than 90 degrees from the equator 129. Limiting the angle 128 to less than 90 degrees is not critical to the performance of the game stick 110 but is preferred so that an upper opening 142 is provided. It is preferred that said spherical radius 126 extends for an angle 128 of between about 20 degrees and about 60 degrees north measured from said equator 129.

Hence, in a preferred embodiment, the frusto-spherical inner surface 132 is truncated to define an upper circular edge 145, a lower circular edge 143, lower opening 140 and upper opening 142 in ball handling toroidal body 131.

The size of the smaller upper opening 142 in the ball-handling member 131 is determined by the angle 128 and is not a critical feature of the invention. The angle 128 determines the thickness of the toroidal body 131 from lower circular edge 143 to upper circular edge 145. A smaller angle, i.e., 20 degrees provides a smaller area in contact between the ball 150 and ball-handling member 130 thus reducing the friction forces between the toroidal body 131 and the ball 150 so that the ball 150 will roll on the surface 155 and slide with respect ball-handling member 130.

Figure 4:
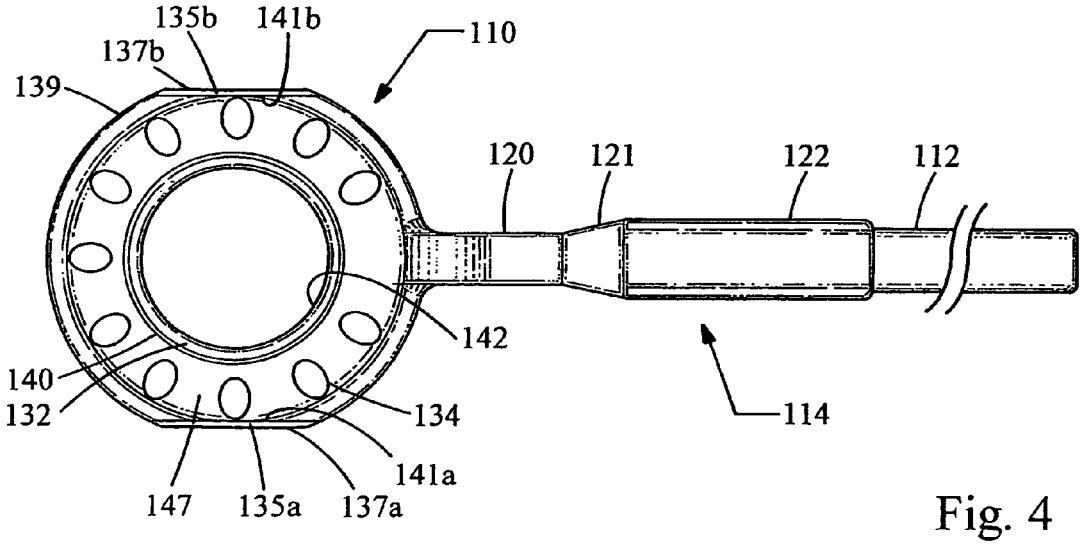
FIG. 4 is bottom plan view of the game stick of FIG. 1.

FIGS. 3 and 4 show additional details of the game stick 110.

FIG. 3 is a top plan view of the game stick 110 of FIG. 1 showing details of the toroidal body 131. Specifically, FIG. 3 illustrates the upper edges 137 and 137*a* of surfaces 135 and 135*a*. Also, FIG. 3 shows the connection of shaft stem 120 to the toroidal body 131.

FIG. 4 is a bottom plan view of the game stick of FIGS. 1 and 3 and shows additional details of the toroidal body 131. In particular, FIG. 4 shows the lower edges 141 and 141*a* of the surfaces 135 and 135*a*. Also shown in FIG. 4 is the frusto-spherical surface 132 and frustoconical surface 147.

Figure 5:
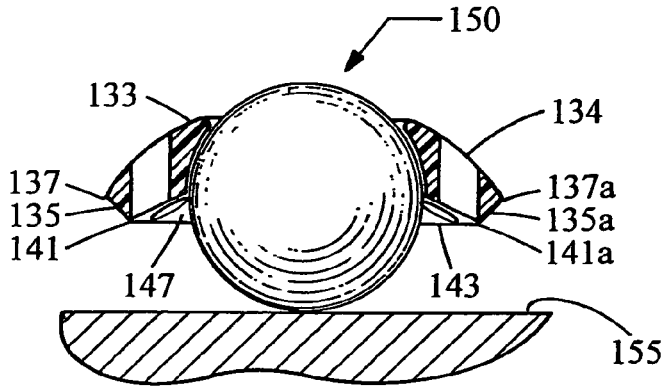
FIG. 5 is a sectional view taken along section line 5-5 in FIG. 3 and showing a preferred spherical game ball in a normal playing position in the game stick of the present invention.

FIG. 5 is a cross-sectional view of the toroidal body 131 and a spherical game ball 150 on a playing surface 155 as it would appear in a typical playing position.

FIG. 5 shows that the toroidal body 131 surrounds and contacts a portion of the northern hemisphere of the game ball 150. The ball 150 can have any size or weight desired but preferably has a diameter of about 3 inches and a weight of 4 to 5 ounces in accordance with the rules of hockey.

The ball 150 is preferably made of a tough, dimensionally stable, tough, abrasion and scratch resistant, low friction material such as DuPont Delrin® 500 acetal homopolymer, ABS, polyurethane, polypropylene polymers or other suitable material. The ball 150 may be solid or hollow or filled with a foam or other filler such as salt and water, oil, etc. that will add mass and help stabilize the motion thereof if desired.

The frictional properties of the material used in making the ball-control member 130, and more specifically, the portion of the toroidal body 131 defining the spherical surface 132 are selected so as to allow the ball 150 to roll on the game surface 155 and slide with respect to the frusto-spherical surface 132.

The playing surface 155 may be constructed of wood, asphalt, concrete, rubber, other elastomeric composite, or other material which is suitably firm to support the playing of the game. The surface 155 should have a relatively high coefficient of friction, such as 0.3 or greater, with respect to the ball 150. Conversely, the coefficient of friction between the inner spherical surface 132 of the toroidal body 131 and the ball 150 should be less than the coefficient of friction between the surface 155 and ball 155. The inner surface 132, 132*b*, 132*c*, or projections 136, of toroidal body 131 should have a low coefficient of friction with respect to the ball 150, i.e., less than 0.30 and preferably less than 0.2.

The higher coefficient of friction between the ball 150 and game surface 155 will assure that normally the ball 150 will roll on the surface 155 and slide with respect to the spherical surface 132 of the toroidal body 131. Preferably, the coefficient of friction between the ball 150 and the spherical surface 132, 132*a*, 132*b*, or 132*c* of the toroidal body 131, 131*a*, or 131*b* or 131*c* shown in FIGS. 5, 5*a*, 5*b*, 5*c* and 5*d* will be as low as is feasible and in any event less than 0.3.

FIGS. 5*a*, 5*b*, 5*c*, and 5*d* illustrate different embodiments of the toroidal body 131 for achieving a low coefficient of friction on the spherical inner surface 132.

Figure 5A:
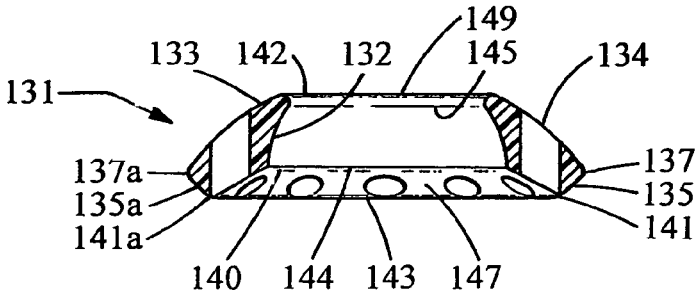
FIG. 5*a* a sectional view taken along the section line 5-5 in FIG. 3 showing one embodiment of the ball-handling member.

FIG. 5*a* shows a toroidal body 131 of ball handling member 130 where the surface 132 is a smooth cast surface of a polymeric material such as DuPont Delrin® 500 acetal homopolymer, nylon, nylon filled with DuPont Teflon tetrafluoroethelene, or other solid lubricant. These materials can be cast to close tolerances, have good dimensional stability, low coefficients of friction, are wear resistant and retain good mechanical properties over a wide range of temperatures (−25 degrees to +80 degrees Celsius).

Figure 5B:
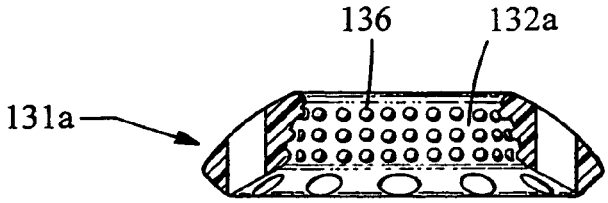
FIG. 5*b* is a sectional view taken along the section line 5-5 in FIG. 3 showing another embodiment of the ball-handling member having friction-reducing protrusions on the inner surface thereof.

FIG. 5*b* shows a toroidal body 131 of ball handling member 130*a* made of a cast polymer of the type described above with respect to FIG. 5*a* wherein the surface 132*a* includes a plurality of generally hemispherical projections 136. The projections 136 reduce the area of contact between the toroidal body 131 and the ball 150 and hence help reduce the friction therebetween.

Figure 5C:
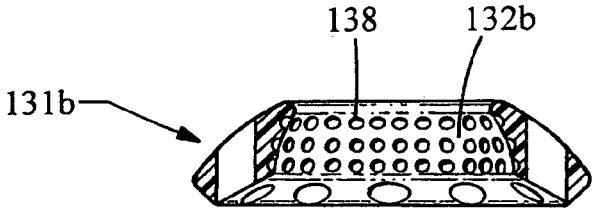
FIG. 5*c* is a sectional view taken along the section line 5-5 in FIG. 3 showing fiction-reducing indentations on the inner surface of the ball-handling member.

FIG. 5*c* shows a a toroidal body 131 of ball handling member 130*b* also made of a cast polymer of the type described above in respect of FIG. 5*a* wherein the surface 132*b* includes a plurality of generally hemispherical depressions or recesses 138. The recesses 138 reduce the surface area which will be in contact with the ball 150 and thereby reduce the friction between the toroidal body 131 and the ball 150.

Figure 5D:
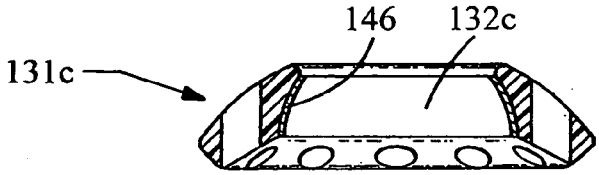
FIG. 5*d* is a sectional view taken along the section line 5-5 in FIG. 3 showing a friction-reducing lining defining the inner surface of the ball handling member.

FIG. 5*d* shows a toroidal body 131 of ball handling member 130*c* which is made from a cast polymer as described above but also includes a low friction liner insert 146 which defines the spherical surface 132*c*. The liner may be cast in place or inserted and held in place by welding, adhesives or other suitable bonding or fastening means. The liner 146 may be made from a tough, low friction, wear resistant material such as steel, DuPont Delrin® 500 acetal homopolymer, nylon, nylon filled with DuPont Teflon or other self lubricating materials or contain a solid lubricant.

Figure 6:
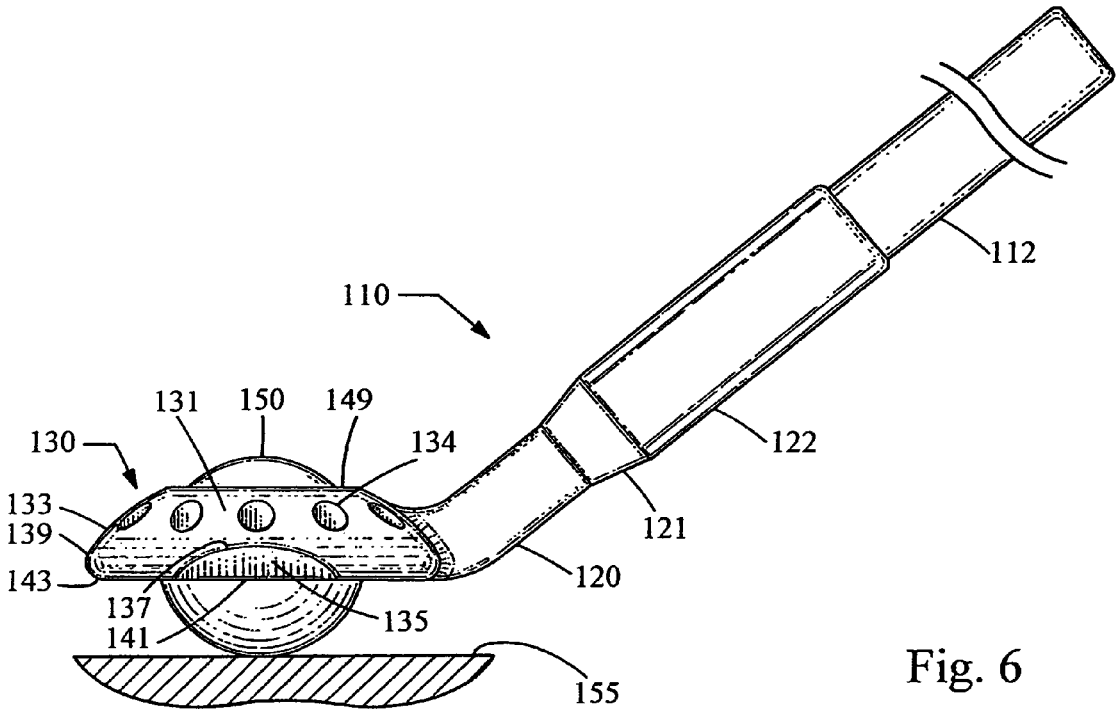
FIG. 6 is a side view of the game stick of the present invention and a typical game ball used with the present invention.

FIG. 6 shows the game stick 110 of FIGS. 1, 3, and 4 with a game ball 150 and playing surface 155 in a normal playing position. As shown in FIG. 6, the frusto-spherical inner surface 132 of the body member 131 fits the outer diameter of the ball 150 and provides a mating engagement therewith at an equator of the ball 150.

FIGS. 7 and 7*a* show a ball-control member 130 with a modified shaft stem 120*a* that includes a male extension 123 thereon. As shown in FIG. 7*b*, the male extension 123 on the modified shaft stem 120*a* mates with female surface 113 of the tubular shaft 112 to form a complete game stick 110.

FIG. 8 shows the toroidal body 131 rotated with respect to the playing surface 155 to a position facilitating passing and shooting of the game ball 150. From the position shown in FIG. 8, the frusto-spherical inner surface 132 is shown rotated such that a champhered surface 135 is near, or in contact with, the playing surface 155. This puts a portion of the frusto-spherical surface 132 of the toroidal body 131 in contact with the ball 150 below a horizontal equator, i.e., below the center of gravity of the ball, allowing a player to use the ball-handling member 130 to lift the ball 150 from the surface 155 and to pass or throw the ball 150 above the game surface 155 through the air to another player or towards a goal.

As shown in various views of the drawing, the ball-handling member 130 may include a plurality of holes 134 spaced around the periphery. The holes do not directly contribute to the invention, but may be used to limit or reduce the mass of the game stick. The holes 134 in the ball-handling member 130 can be eliminated from the ball-handling member 130 if desired.

The game envisioned by this invention can, in virtually all respects, be similar to ice hockey but is preferably played on a flat surface 155 having a relatively high coefficient of friction, i.e., preferably above 0.3, and may be constructed of wood, concrete, polymer, composite, or other suitable material. Specifically, the game stick 110 is for use in controlling, passing and shooting the spherical ball 150 on a flat surface 155 in a game, such as hockey, played by one or more participants who may play the game by running or using roller blades or skates.

As stated above, the game surface 155 should be relatively flat and preferably has a relatively high coefficient of friction, e.g., 0.3 or greater, so that the ball 150 will roll on the surface 155 and slide with respect to the inner surface 132 of the ball handling and control member 130.

The lower opening 140 of the downwardly facing cup-shaped ball-handling member 130, in the preferred embodiment, has a radius that is larger, by 0.025 to 0.050 inch, than the radius of the spherical ball 150 that is intended for use with the game stick 110.

Hence, in the preferred embodiment of the invention, the frusto-spherical cup-shaped surface 132 in the ball-handling member 130 fits over the game ball 150 and is in mating engagement therewith, to, or very near, the equator of the ball when the ball 150 is located in the lower opening 140

The angle 128 and the resulting area of spherical surface 132 will determine the level of skill required by the players to control passing and throwing of the ball 150. The angle 128 may be any angle less than 90 degrees, but is preferably between about 20 degrees and 60 degrees. A smaller angle, i.e., 20 degrees, will require greater skill from the players to control the path or trajectory of a thrown or passed ball.

As stated above, the radius of the spherical inner surface 132, or in the case of the embodiment of FIG. 5*b* the spherical radius defined by the protrusions 136, is slightly greater, i.e., by between 0.025 inches and 0.050 inches, than the radius of the game ball 150 to provide a good mating fit between the surface 132 and ball 150 giving the player good control over movement of the ball 150 but keeping the frictional forces between the ball 150 and ball handling and control member 130 sufficiently low as to permit the ball 150 to roll on the game surface 155 and slide with respect to the surface 132, 132*a*, 132*b*, 132*c*, or protrusions 136.

The upper smaller opening 142 in the body member 131 permits a player to observe the motion of the ball 150. The motion of the ball 150 provides information that can be used by the player in determining if an adjustment is needed in terms of increasing or reducing a vertical force on the ball 150 to maintain a smooth rolling motion of the ball 150.

It is intended that a player will catch or capture the ball 150 in the cup-shaped depression 132 in the ball-handling member 130 and run or skate with the ball 150 contained between the member 130 and the surface 155. The player can use the shaft 112 to apply a downward force on the ball-handling member 130 to achieve greater stability during running or skating and prevent players on another team from taking possession of the ball 150.

A player can use the game stick 120 to capture, control, maneuver and pass the ball 150 to other players or shoot the ball 150 toward a goal (not shown).

The cross-sectional profile of the ball-handling member 130 comprises curved or sharply angled surfaces and will probably reduce a player's ability to hit the ball in a "slap shot" manner. This will require the players to develop additional skills to use the ball-handling member 130 to pass, throw or shoot the ball 150.

In passing, throwing or shooting the ball 150, the player can use a sliding or sweeping motion keeping the ball 150 contained between the playing surface 155 and cup-shaped depression in the ball-handling member 130 until the ball-handling member 130 is tilted to a position as shown in FIG. 8 at which point, the ball 150 can be lifted from the playing surface 155 and thrown towards another player or the goal.

In other words, it is the expectation that the invention will require the players to maintain the game stick 110 in contact with the ball 150 in manuevering, carrying, passing or shooting the ball 150.

With the ball-handling member 130 rotated as shown in FIG. 8, the frusto-spherical surface 132 covers a portion of the surface of the ball 150 to below the equator thereof. As a result, the spherical surface 132 provides support for the ball 150 below its center of gravity. This support allows a player to lift the ball 150 from the playing surface 155 and pass or throw the ball 155 through the air above the surface 155 either to another player, toward a goal, or otherwise.

I claim:

1. Apparatus for playing a running or skating game on a playing surface comprising:

a spherical ball; and a game stick comprising a toroidal ball-handling member and an elongate shaft attached thereto and extending therefrom, said ball-handling member having a generally arcuate outer surface including a flat portion parallel to the elongate shaft, and a frusto-spherical cup-shaped inner surface, the inner surface adapted for mating engagement with an area of a hemisphere of the ball, and said inner surface of the ball-handling member having a co-efficient of friction that is equal to or less than the co-efficient of friction of the ball whereby said elongate shaft is capable of providing support for a skating or running player and controlling said ball-handling member.

2. The ball and game stick of claim 1 wherein:

said frusto-spherical inner surface of the ball-handling member is adapted to matingly engage the upper hemisphere of the ball from the equator for an angle of less than 90 degrees.

3. The ball and game stick of claim 1 wherein:

said frusto-spherical inner surface of the ball-handling member matingly engages a portion of the upper hemisphere of the ball from the equator for an angle of between 20 and 60 degrees.

4. The ball and game stick of claim 1 wherein:

the frusto-spherical inner surface of the ball-handling member and the outer surface of the ball have a coefficient of friction of less than 0.3.

5. The ball and game stick of claim 4 wherein:

the frusto-spherical inner surface of the ball-handling member and the outer surface of the ball have a coefficient of friction of less than 0.2.

6. The ball and game stick of claim 1 wherein:

a portion of the toroidal ball-handling member adapted to propel the ball through contact and impact includes champhered surfaces on each side thereof parallel to the longitudinal axis of the shaft.

7. The ball and game stick of claim 1 wherein:

the elongate shaft attached to the ball-handling member extends from the ball-handling member at an angle between 20 degrees and 40 degrees.

8. The ball and game stick of claim 7 wherein:

the ball-handling member has a male portion extending therefrom; and the shaft is hollow and includes a portion matingly engaging the male portion of the ball-handling member.

9. The ball and game stick of claim 7 wherein:

the ball-handling member has a female opening therein; and the shaft matingly engages the female opening in the ball-handling member facilitating replacement of the shaft.

10. The ball and game stick of claim 1 wherein the ball-handling member is made of a low friction, scratch and wear resistant material.

11. Apparatus for playing a running or skating game on a playing surface comprising:

a spherical ball; and a game stick comprising a toroidal ball-handling member and an elongate shaft attached thereto and extending therefrom, said ball-handling member having a generally arcuate outer surface including a flat portion parallel to the elongate shaft, and a frusto-spherical cup-shaped inner surface, the inner surface having a plurality of hemispherical projections adapted for mating engagement with a portion of the upper hemisphere of the ball, and having an outer surface including champhered surfaces parallel to the longitudinal axis of the shaft;

whereby said elongate shaft is capable of providing support for a skating or running player and controlling said ball-handling member.

12. Apparatus for playing a running or skating game on a playing surface comprising:

a spherical ball; and a game stick comprising a toroidal ball-handling member and an elongate shaft attached thereto and extending therefrom, said ball-handling member having a generally arcuate outer surface including a flat portion parallel to the elongate shaft, and a frusto-spherical cup-shaped inner surface, the inner surface having a plurality of depressions therein and adapted for mating engagement with a portion of the upper hemisphere of the ball, and having an outer surface including champhered surfaces parallel to the longitudinal axis of the shaft;

whereby said elongate shaft is capable of providing support for a skating or running player and controlling said ball-handling member.

13. The ball and game stick of claim 12 wherein the depressions in the frusto-spherical cup-shaped inner surface are hemispherical.

* * * * *